US008141980B2

(12) United States Patent
O'Neal

(10) Patent No.: US 8,141,980 B2
(45) Date of Patent: Mar. 27, 2012

(54) INK TRAY OF A PRODUCTION PRINTING SYSTEM HAVING AN OPEN BOTTOM SECTION

(75) Inventor: James O'Neal, Lyons, CO (US)

(73) Assignee: Ricoh Production Print Solutions LLC, Boulder, CO (US)

( * ) Notice: Subject to any disclaimer, the term of this patent is extended or adjusted under 35 U.S.C. 154(b) by 700 days.

(21) Appl. No.: 12/244,500

(22) Filed: Oct. 2, 2008

(65) Prior Publication Data

US 2010/0085400 A1 Apr. 8, 2010

(51) Int. Cl.
*B41J 2/165* (2006.01)

(52) U.S. Cl. ..... 347/31

(58) Field of Classification Search ..... 347/31
See application file for complete search history.

(56) References Cited

U.S. PATENT DOCUMENTS 2,073,892 A * 3/1937 Ward ..... 220/23.6
4,884,683 A * 12/1989 Ford ..... 206/163
5,279,800 A * 1/1994 Berry, Jr. ..... 422/300
5,546,116 A 8/1996 Nardone et al.
5,589,865 A 12/1996 Beeson
6,789,875 B2 9/2004 Wotton et al.
6,890,056 B2 5/2005 Johnson et al.
7,296,876 B2 * 11/2007 Kagami et al. ..... 347/36
2007/0076048 A1 4/2007 Cunnington et al.
2007/0097171 A1 * 5/2007 Kagami et al. ..... 347/31
2007/0153035 A1 * 7/2007 Jung et al. ..... 347/9

* cited by examiner

*Primary Examiner* — Mark Robinson
*Assistant Examiner* — Andrew Jordan
(74) *Attorney, Agent, or Firm* — Duft Bornsen & Fishman, LLP

(57) ABSTRACT

Production printing systems are disclosed. The production printing system comprises a printhead array operable to discharge ink to print on a printable medium, and an ink tray that is affixed in the printing system facing the printhead array. The ink tray has a bottom section that is open. The production printing system further comprises a tray insert adapted to rest in the ink tray and to be lifted from the ink tray, and an ink absorbing element adapted to rest in the tray insert and operable to absorb ink that is discharged from the printhead array when the ink does not contact the printable medium. With the tray insert removed from the ink tray, the printhead array is visible through the bottom of the ink tray so that the printheads may be inspected or cleaned.

12 Claims, 11 Drawing Sheets

INK TRAY OF A PRODUCTION PRINTING SYSTEM HAVING AN OPEN BOTTOM SECTION

BACKGROUND OF THE INVENTION

1. Field of the Invention

The invention relates to the field of production printing systems and, in particular, to an ink tray that has an open bottom section so that printhead arrays in the production printing system may be inspected or cleaned through the bottom of the ink tray.

2. Statement of the Problem

Businesses or other entities having a need for volume printing typically purchase a production printing system. A production printing system comprises a high-speed printer used for volume printing, such as 100 pages per minute or more. The production printing systems are typically continuous-forms printers that print on paper or some other printable medium that is stored on large rolls. Some continuous-forms printers are able to print on paper up to 20 inches wide or more.

A production printing system typically includes a localized print controller that controls the overall operation of the printing system, and one or more print engines (sometimes also referred to as an "imaging engine" or as a "marking engine"). The print engines include a printhead controller and arrays of printheads. An individual printhead includes multiple tiny nozzles (e.g., 360 nozzles per printhead depending on resolution) that are operable to discharge ink as controlled by the printhead controller. The printhead array is formed from multiple printheads that are spaced in series along a particular width, such as 20 inches.

When in operation, the printable medium is passed underneath the printhead arrays while the nozzles of the printheads discharge ink at particular intervals to form pixels on the medium. There are times when the printheads discharge ink outside of the margin of the printable medium. For example, the printing system may run a cleaning cycle which causes each nozzle to discharge ink even when the printable medium is not positioned underneath the printheads. The cleaning cycle is run periodically to avoid clogging of the nozzles. In another example, the printing system may be printing on a medium that is less than the width of the printhead array. For example, a printing system having 20 inch arrays may be printing on an 8.5 inch medium. Instead of shutting off the printheads or nozzles that are not being used to print to the medium and risking that the unused nozzles become clogged, the printheads outside of the margin of the medium are still turned on periodically to avoid clogging. When the printheads discharge ink and there is no printable medium underneath the printheads, the ink being discharged would make an undesirable mess if the ink were not captured in some manner.

Presently, ink trays are affixed or fastened to the printing system opposite the printheads and facing the printheads when they are in a printing position (as opposed to a parked position). The ink trays have a width at least as wide as the printhead arrays, and typically a sponge or some other ink absorbing element is placed within the ink trays. Thus, when the printheads discharge ink outside of the margin of the medium, the ink is absorbed by the ink absorbing elements in the ink trays. The ink trays are open at the top and enclosed at the bottom to act as a container. When the ink absorbing elements within the ink trays become saturated, the excess ink is contained in the ink trays.

One problem with present printing systems is that the printheads are not visible to the printer operator when the printhead arrays are in the printing position. As described above, when the printhead arrays are moved to the printing position, the printhead arrays are directly facing the ink trays (i.e., within a few millimeters) so that the ink trays may absorb or capture any excess ink that is discharged outside of the margins of the medium. If the printer operator wants to inspect or clean the printheads while the printhead arrays are in the printing position, he/she would not be able to as the ink trays would be blocking the printhead arrays. Thus, the printer operator would have to detach the ink trays from the printing system in order to inspect the printhead arrays. Unfortunately, the ink trays are affixed or fastened to the printing system in a rigid but removable fashion. For example, ink trays in some printing systems are bolted to frame of the printing system on either one end or both ends. Thus, to remove the ink trays, the printer operator has to remove the bolts, screws, or another fastening member from the ink trays, and then attempt to remove the ink trays from the printing system. Removal of the ink trays may then require sliding, twisting, or otherwise manipulating the position of the ink trays in order to detach it from the frame, and extricate it from the printing system. Removing the ink trays can be time consuming, and the printer operator may accidently spill ink that is being contained in the ink trays while attempting to remove the ink trays.

SUMMARY OF THE INVENTION

Embodiments of the present invention solve the above and other related problems by having the bottom of the ink trays be substantially open. In one embodiment, a bottom section of the ink tray has an opening that the printer operator can see through. Because the ink tray does not have a container structure, a tray insert is placed inside of the ink tray, which does have a container structure. The tray insert thus holds an ink absorbing element, such as a sponge, instead of the ink absorbing element being placed directly in the ink tray. The tray insert rests in the ink tray in a removable fashion so that the tray insert may be lifted from the ink tray to remove the ink absorbing element from the printing system.

When the printer operator wants to inspect or clean the printhead arrays, the printer operator may simply lift the tray inserts from the ink trays. With the tray inserts removed, the printer operator may inspect the printhead arrays through the opening in the ink trays. Because the printer operator may see through the bottom of the ink trays, the printhead arrays may advantageously be inspected without having to detach the ink trays from the printing system. The printer operator may also clean the face of the printheads through the opening in the ink trays.

One embodiment comprises a production printing system. The production printing system comprises a printhead array operable to discharge ink to print on a printable medium, and an ink tray that is affixed in the printing system facing the printhead array. The ink tray has a bottom section that is open. The production printing system further comprises a tray insert adapted to rest in the ink tray and to be lifted from the ink tray, and an ink absorbing element adapted to rest in the tray insert and operable to absorb ink that is discharged from the printhead array when the ink does not contact the printable medium. The invention may include other exemplary embodiments described below.

DESCRIPTION OF THE DRAWINGS

The same reference number represents the same element or same type of element on all drawings.

DETAILED DESCRIPTION

FIGS. 1-11 and the following description depict specific exemplary embodiments of the present invention to teach those skilled in the art how to make and use the invention. For the purpose of this teaching, some conventional aspects of the invention have been simplified or omitted. Those skilled in the art will appreciate variations from these embodiments that fall within the scope of the present invention. Those skilled in the art will appreciate that the features described below can be combined in various ways to form multiple variations of the present invention. As a result, the invention is not limited to the specific embodiments described below, but only by the claims and their equivalents.

Figure 1:
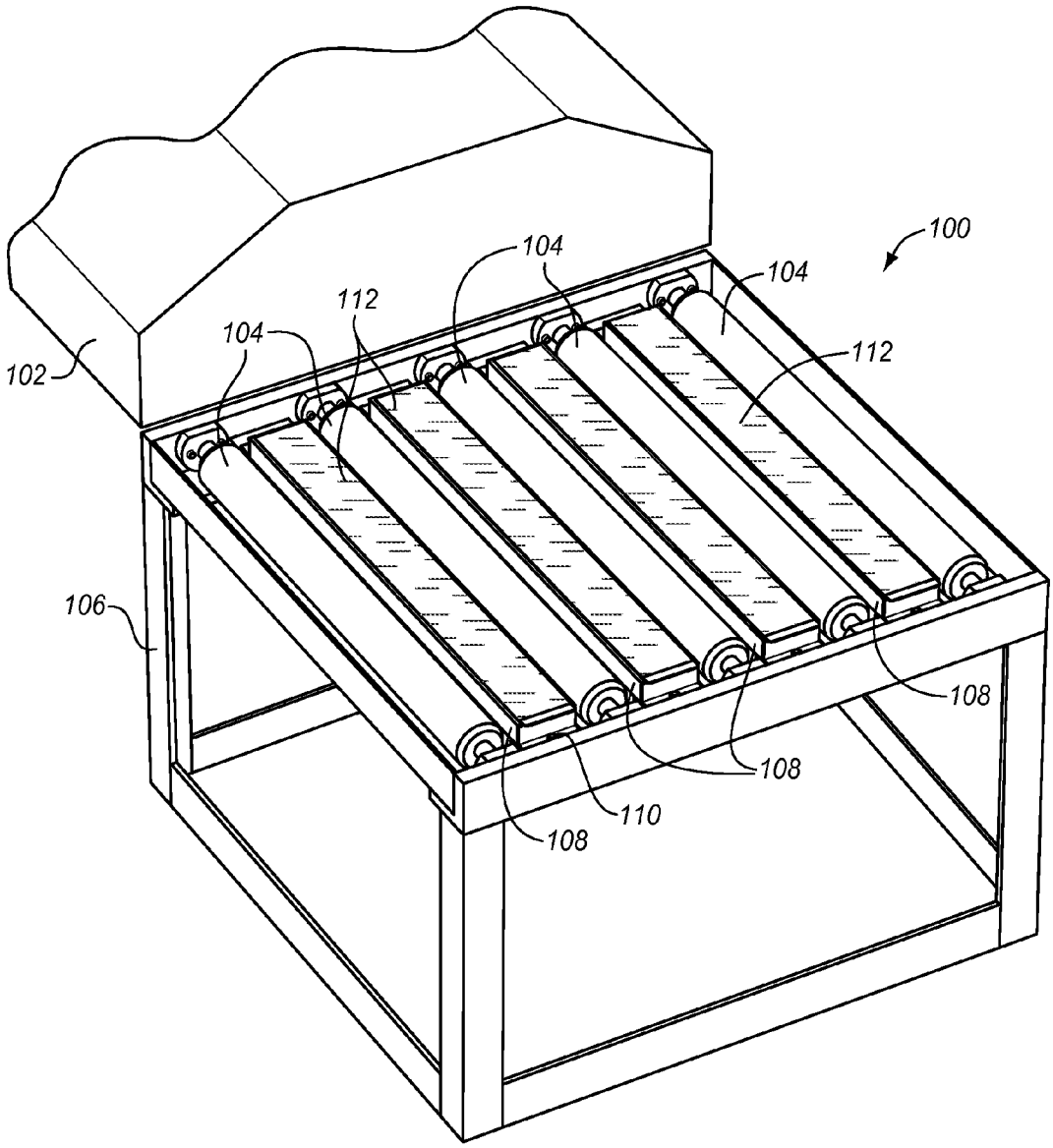
FIG. 1 is an isometric view of a production printing system.

FIG. 1 is an isometric view of a production printing system 100. Printing system 100 comprises any system used to provide marks on a media, such as a continuous forms printer or a cut sheet page printer. In this embodiment, printing system 100 comprises a production printing system that is a high-speed printer used for volume printing, such as 100 pages per minute or more.

In this embodiment, printing system 100 includes one or more printhead arrays that are located underneath hood 102. The printhead arrays are in a parked position in FIG. 1. Printing system 100 further includes a plurality of rollers 104 that support one surface of a printable medium (i.e., a bottom surface) as the medium is passed underneath the printhead arrays to allow the printheads to print on the opposite surface of the medium (i.e., the top surface). For example, the printable medium may pass over rollers 104 from right to left in FIG. 1.

Printing system 100 also includes a plurality of ink trays 108 that are located proximate to rollers 104. For example, ink trays 108 may be located in between rollers 104 as shown in FIG. 1. Ink absorbing elements 112, such as sponges, are placed in ink trays 108. Each of the ink trays 108 are affixed or fastened to the frame 106 of printing system 100 by fastening members 110. Fastening members 110 may comprise bolts, screws, etc. Ink trays 108 have a width at least as wide as the printhead arrays (i.e., slightly larger). For example, if the width of the printhead arrays is 20 inches, then the width of ink trays 108 is approximately 20.5 inches.

Figure 2:
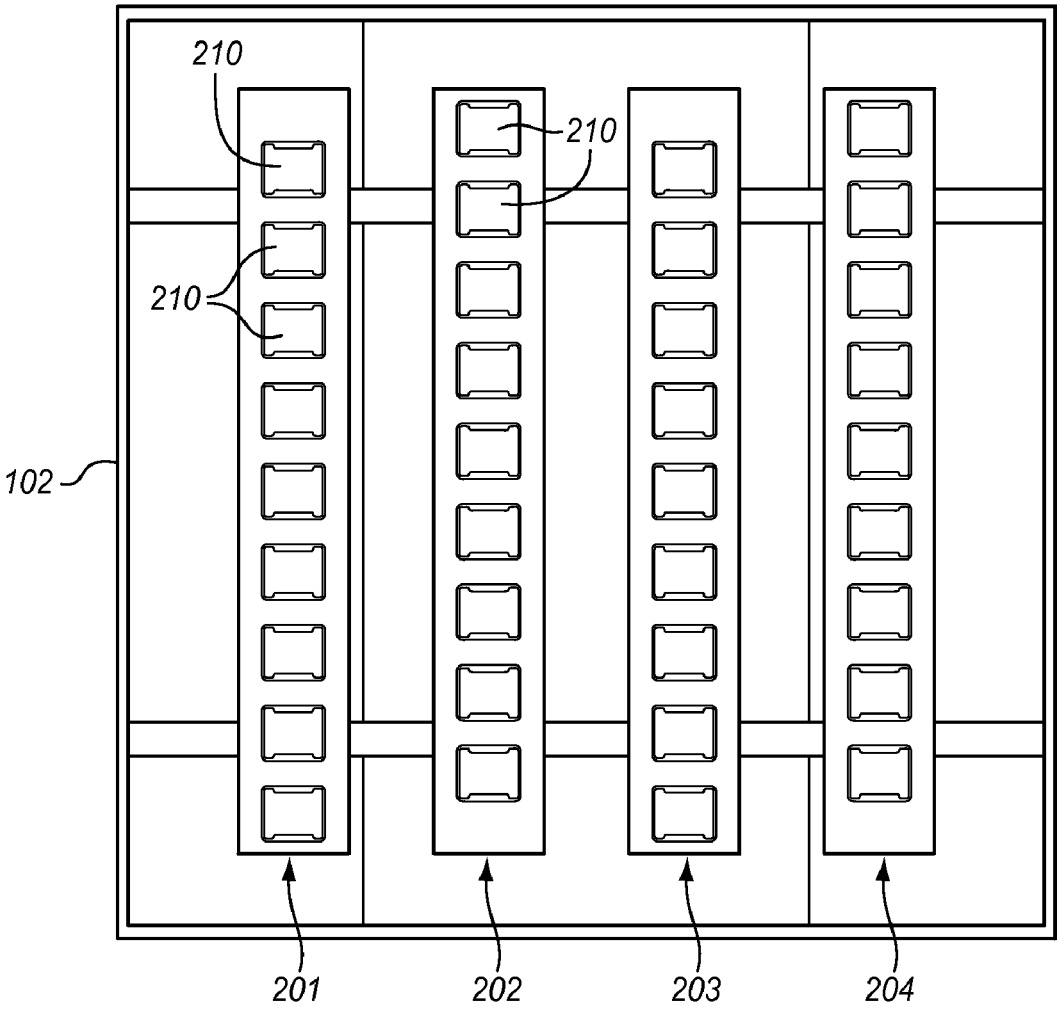
FIG. 2 illustrates a plurality of printhead arrays.

FIG. 2 illustrates a plurality of printhead arrays 201-204. Printhead arrays 201-204 are implemented underneath hood 102 as shown in FIG. 1 to be facing downward. Each printhead array 201-204 is comprised of a plurality of printheads 210. Each individual printhead 210 includes multiple tiny nozzles (e.g., 360 nozzles per printhead depending on resolution) that are operable to discharge ink.

Figure 3:
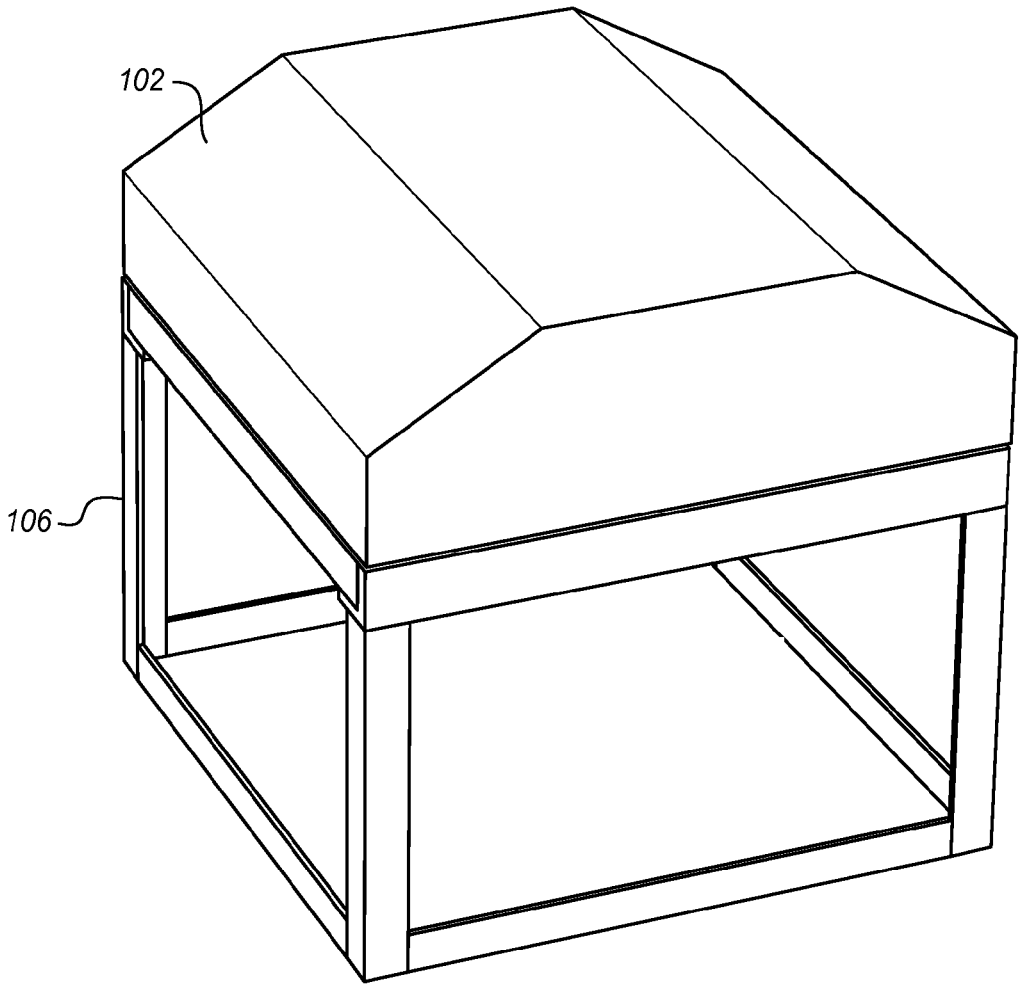
FIG. 3 is an isometric view of a production printing system illustrating printhead arrays moved to a printing position.
Figure 4:
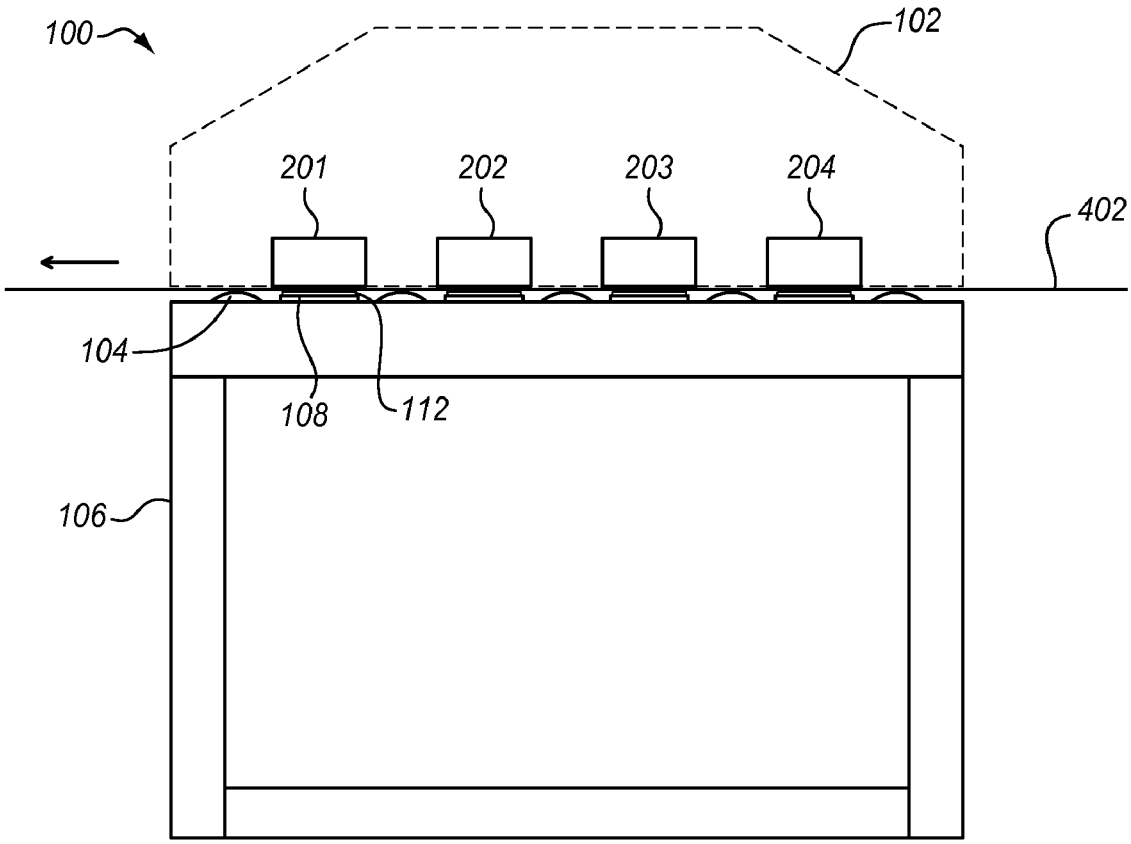
FIG. 4 is a side view of a production printing system illustrating printhead arrays in a printing position.

When a print job is sent to printing system 100, printhead arrays 201-204 are moved from the parked position to a printing position. FIG. 3 is an isometric view of printing system 100 illustrating the printhead arrays 201-204 moved to the printing position. With the printhead arrays 201-204 moved to the printing position, a printable medium (i.e., paper) may be passed over top of rollers 104 and underneath the printhead arrays 201-204. FIG. 4 is a side view of printing system 100 illustrating the printhead arrays 201-204 in the printing position. To print the print job, printable medium 402 is passed (from right to left) over top of rollers 104 and underneath printhead arrays 201-204. While the printable medium 402 is moving underneath printhead arrays 201-204, the printhead arrays 201-204 discharge ink on the medium 402 to image the print job on medium 402.

Figure 5:
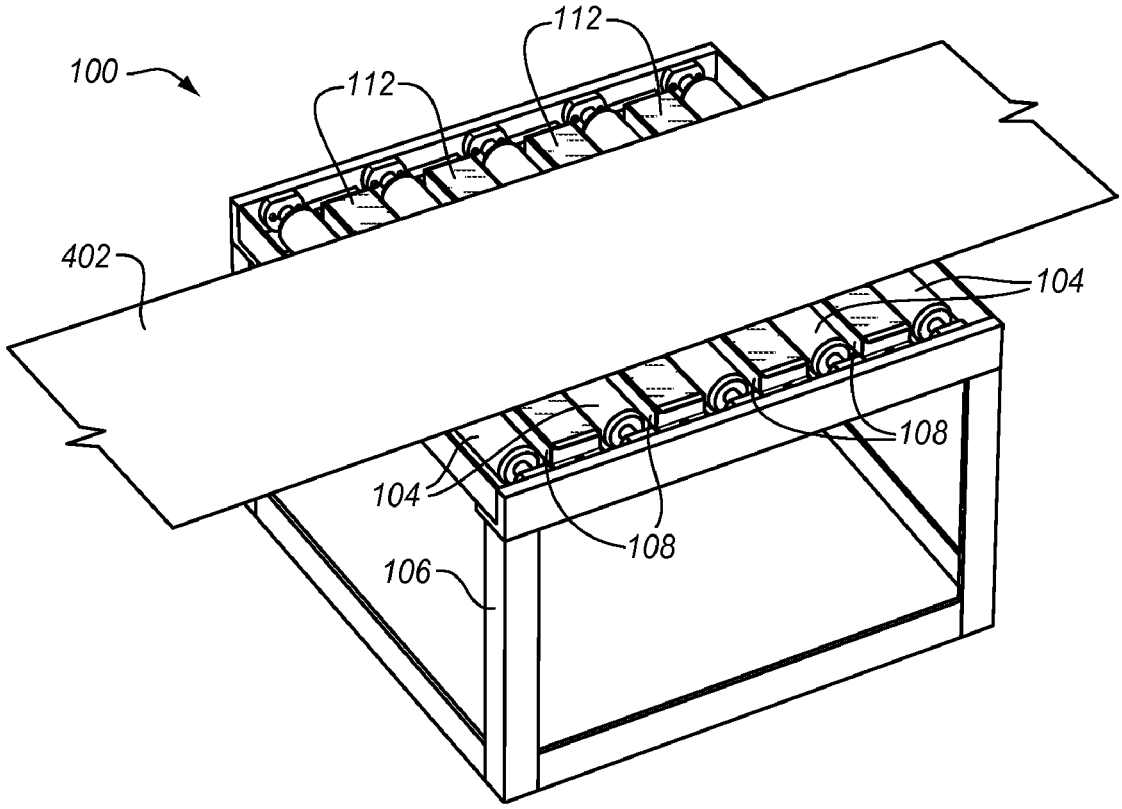
FIG. 5 is an isometric view of a production printing system illustrating a printable medium passing over rollers.

There may be instances when printing system 100 is printing on a medium 402 that is not as wide as printhead arrays 201-204. For example, printing system 100 may be printing on 8.5 inch paper even though the printhead arrays 201-204 are 20 inches wide. FIG. 5 is an isometric view of printing system 100 illustrating a printable medium 402 passing over rollers 104. Printhead arrays 201-204 are not shown in FIG. 5, but have a similar width as ink trays 108. It is evident in FIG. 5 that the width of printable medium 402 is not as wide as the printhead arrays 201-204. Instead of shutting off the printheads 210 or nozzles that are not being used to print to medium 402 and risking that the unused nozzles become clogged, the printheads 210 that are not being used to print for this print job are still turned on periodically to avoid clogging. This means that printhead arrays 201-204 may discharge outside of the margins of medium 402. Ink trays 108 are adapted to collect the ink that is discharged outside of the margins.

There may also be instances where printing system 100 runs a cleaning cycle which causes printhead arrays 201-204 to discharge ink from each nozzle. Ink trays 108 are also adapted to collect ink that is discharged during the cleaning cycle.

As is illustrated in FIG. 4, ink trays 108 are located opposite printhead arrays 201-204 and facing printhead arrays 201-204. Ink trays 108 are also at least as wide as printhead arrays 201-204 so that ink trays 108 may collect any ink discharged from printhead arrays 201-204 that does not contact medium 402.

Figure 6:
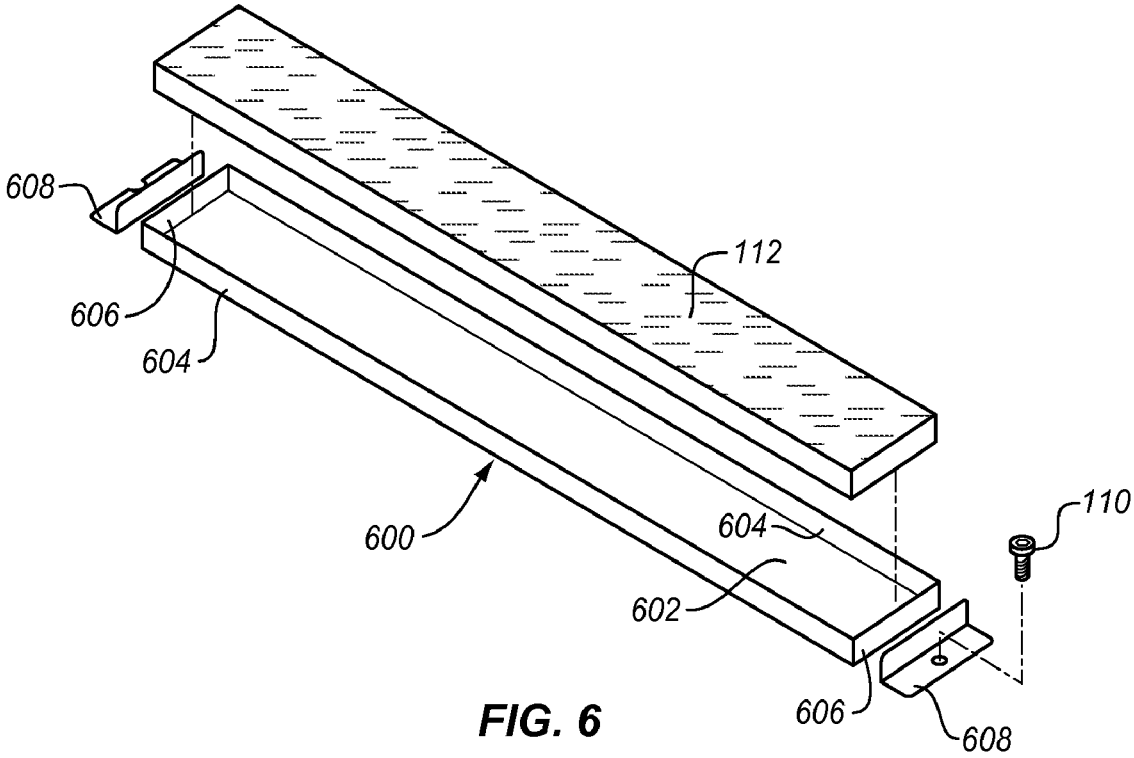
FIG. 6 PRIOR ART
FIG. 6 is an isometric view of an ink tray in the prior art.

FIG. 6 is an isometric view of an ink tray 600 in the prior art. Ink tray 600 has a substantially flat bottom section 602, and includes two side sections 604 and two end sections 606 that extend perpendicularly from bottom section 602. The bottom section 602, two side sections 604, and two end sections 606 are welded or otherwise connected to one another in a sealed fashion to form a container structure that is open at the top and enclosed at the bottom to contain a liquid. Ink absorbing element 112 is able to rest on the bottom section 602 of ink tray 600 to absorb ink discharged from the printheads. The container structure of ink tray 600 allows ink tray 600 to contain excess ink that is not absorbed by ink absorbing element 112.

Ink tray 600 also includes connecting members 608 affixed to each end section 606. Connecting members 608 are used to fasten ink tray 600 to the frame 106 of printing system 100 (see FIG. 1) in a rigid but removable fashion. As illustrated in FIG. 6, the leftmost connecting member 608 is adapted to mate with a corresponding connecting member (not shown) on frame 106 to secure ink tray 600 to frame 106. The rightmost connecting member 608 is adapted to fasten to frame 106 through fastening member 110.

Imagine for example that ink trays 600 are used in printing system 100 in place of ink trays 108 in FIGS. 1 and 4. Because ink trays 600 are positioned in the printing system 100 immediately facing printhead arrays 201-204 in order to collect discharged ink, the ink trays 600 unfortunately block the view to the printhead arrays 201-204. There may be instances when the printer operator may want to inspect or clean the printheads 210 while the printhead arrays 201-204 are in the printing position. To inspect or clean the printheads 210, the printer operator would have to detach the ink trays 600 from printing system 100, which may be time consuming and may risk spilling the ink being contained ink trays 600 into printing system 100.

To avoid this problem in the following embodiments, the bottoms of the ink trays 108 are made open so that the printer operator can inspect or clean the printheads 210 through the bottom of the ink trays 108. A removable tray insert is also implemented in the ink trays 108 that are adapted to hold the ink absorbing elements 112. Thus, the removable tray inserts are used in the ink trays 108 to both hold the ink absorbing elements 112 and contain the excess ink, as is further illustrated in FIG. 7.

Figure 7:
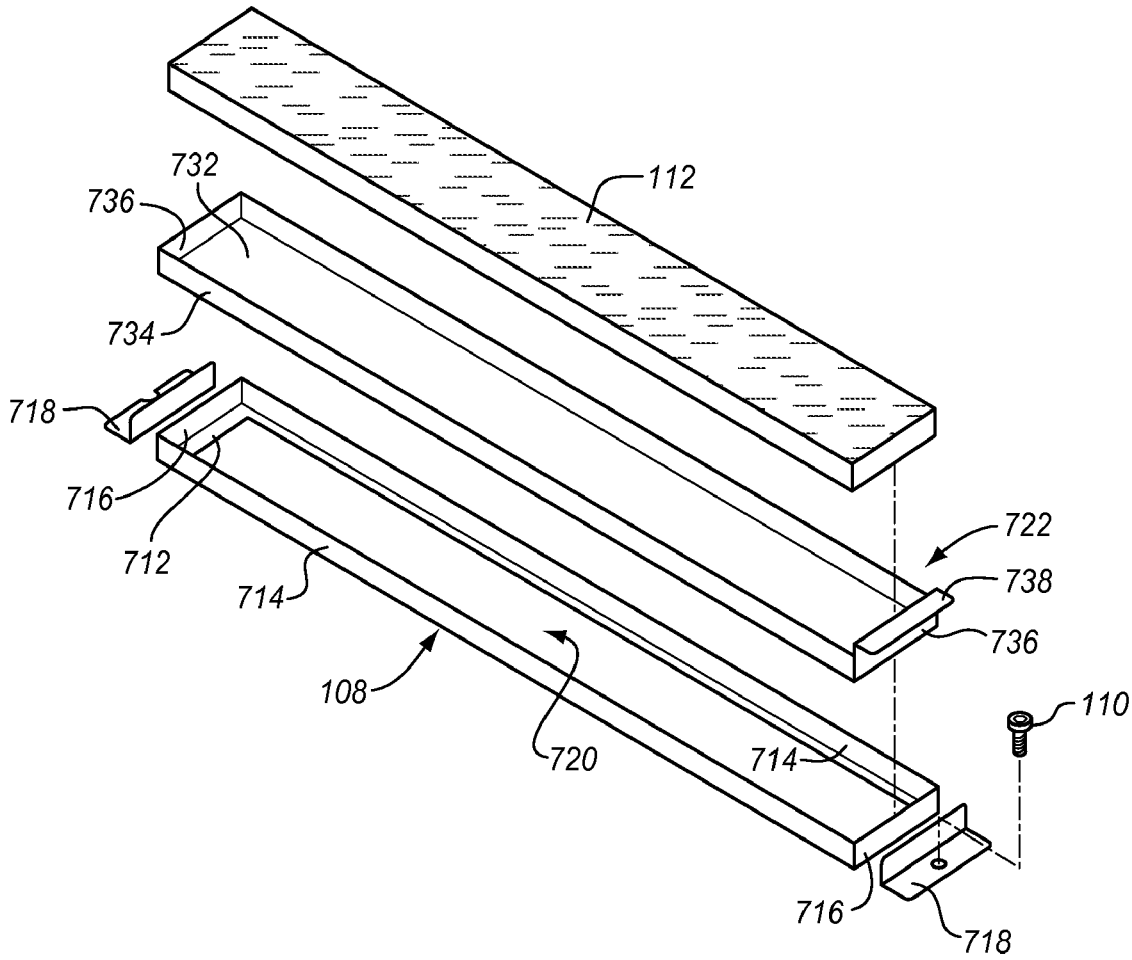
FIG. 7 is an isometric view of an ink tray with an opening in its bottom section in an exemplary embodiment of the invention.

FIG. 7 is an isometric view of an ink tray 108 in an exemplary embodiment of the invention. Ink tray 108 includes a bottom section, two side sections 714, and two end sections 716 that are connected to one another. In this embodiment, the bottom section of ink tray 108 includes a border 712 (also referred to as an edge, rim, frame, etc) around its outer edges that connects to side sections 714 and end sections 716. The width of border 712 may vary as desired. For example, the width of border 712 may be 1 inch, ½ inch, etc, as desired. Border 712 is generally used to support a tray insert 722, but those skilled in the art understand that tray insert 722 may be supported in ink tray 108 in other ways, meaning that border 712 may be eliminated all together.

Figure 8:
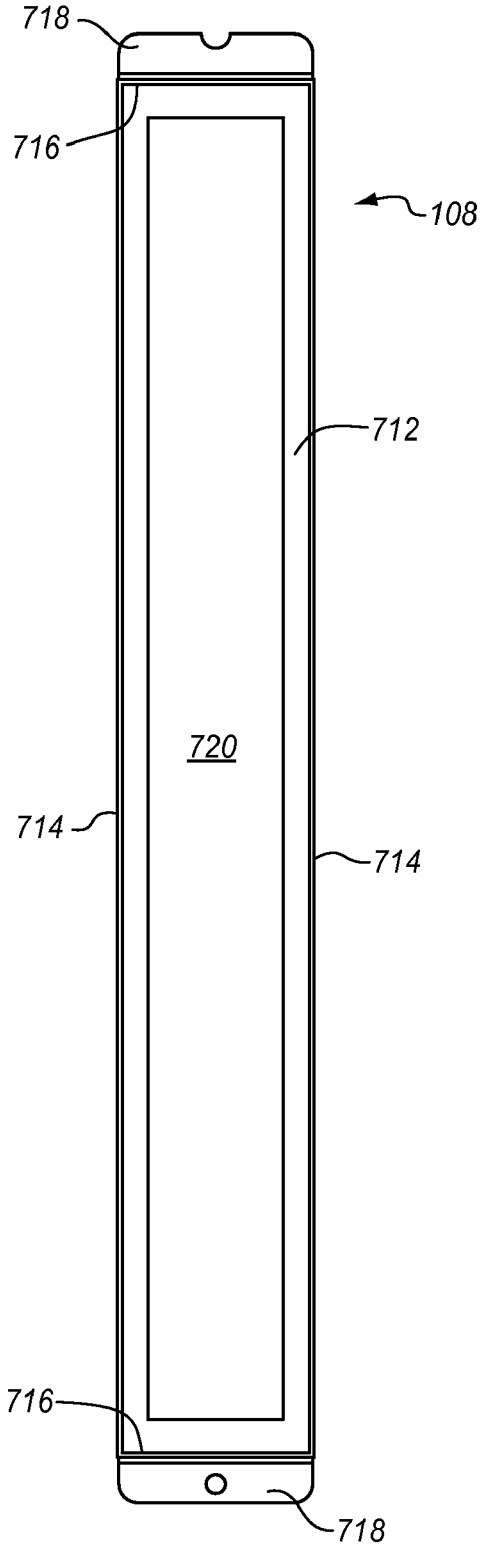
FIG. 8 is a top view of the ink tray having the opening in an exemplary embodiment of the invention.

The bottom section of ink tray 108 also includes an opening 720 within the border 712. Opening 720 comprises some aperture or void in the bottom of ink tray 108 that is see-through. Opening 720 is of sufficient size so that a printhead array 201-204, and each of the printheads 210, would be visible when tray insert 722 is removed from ink tray 108. For example, opening 720 may have a width (i.e., the dimension of the major plane) at least as wide as a printhead array 201-204 (i.e., slightly larger) so that the entire printhead array 201-204 is visible. FIG. 8 is a top view of ink tray 108 in an exemplary embodiment of the invention, which further illustrates the structure of the bottom section of ink tray 108 with a border 712 and an opening 720.

Although ink tray 108 has an opening 720 in the embodiment illustrated in FIG. 7, ink tray 108 could have any kind of see-through or transparent bottom section. For example, opening 720 may be replaced with glass, Plexiglas®, or some other transparent material.

With ink tray 108 having the characteristic of being "see-through", ink tray 108 is not able to contain excess ink as does ink tray 600 in FIG. 6. Thus, a removable tray insert 722 is placed within ink tray 108 to contain the excess ink as illustrated in FIG. 7. Tray insert 722 includes a bottom section 732, two side sections 734, and two end sections 736 that are connected to one another in a sealed fashion to form a container structure that is open at the top and enclosed at the bottom to contain a liquid, such as ink. Tray insert 722 has outer dimensions that are slightly less than the inner dimensions of ink tray 108 so that tray insert 722 is able to rest in or on ink tray 108. Tray insert 722 has a width at least as wide as the printhead arrays 201-204 in printing system 100 in order to collect the ink that is discharged from the printheads 210. For example, if the width of the printhead arrays 201-204 is 20 inches, then the width of tray insert 722 is approximately 20.5 inches.

Tray insert 722 fits in or on ink tray 108 in a removable fashion so that it may be lifted from the ink tray 108 to remove ink absorbing element 112 from printing system 100. Tray insert 722 is not rigidly affixed or fastened to ink tray 108. In other words, tray insert 722 is not bolted or otherwise affixed to printing system 100 or ink tray 108. Thus, tray insert 722 is easily removed from ink tray 108 by simply lifting tray insert 722 from ink tray 108. To assist in lifting tray insert 722 from ink tray 108, tray insert 722 may have a lip 738 on one end section 736 to allow the printer operator to grasp the tray insert 722 and lift tray insert 722 out of ink tray 108. Although a lip 738 is illustrated in FIG. 7, tray insert 722 may include some type of handle or other lifting member which allows the printer operator to grasp the tray insert 722 and lift tray insert 722 out of ink tray 108. Tray insert 722 may be formed from plastic or some other material that is relatively light-weight so that the printer operator can easily lift tray insert 722 from ink tray 108.

Tray insert 722 is open at the top to receive ink absorbing element 112. Ink absorbing element 112 spans the width of tray insert 722 to absorb the ink discharged outside of the margins (i.e., ink that does not contact the printable medium). Because tray insert 722 is enclosed at the bottom to form a container structure, tray insert 722 is able to contain excess ink that is not absorbed by ink absorbing element 112. The inner dimensions of tray insert 722 may be approximately the dimensions of ink absorbing element 112 in order to hold ink absorbing element 112. Alternatively, the inner dimensions of tray insert 722 may be deeper than the dimensions of ink absorbing element 112 and tapered toward the bottom so that excess ink pooling in the bottom of tray insert 722 does not necessarily contact ink absorbing element 112.

Figure 9:
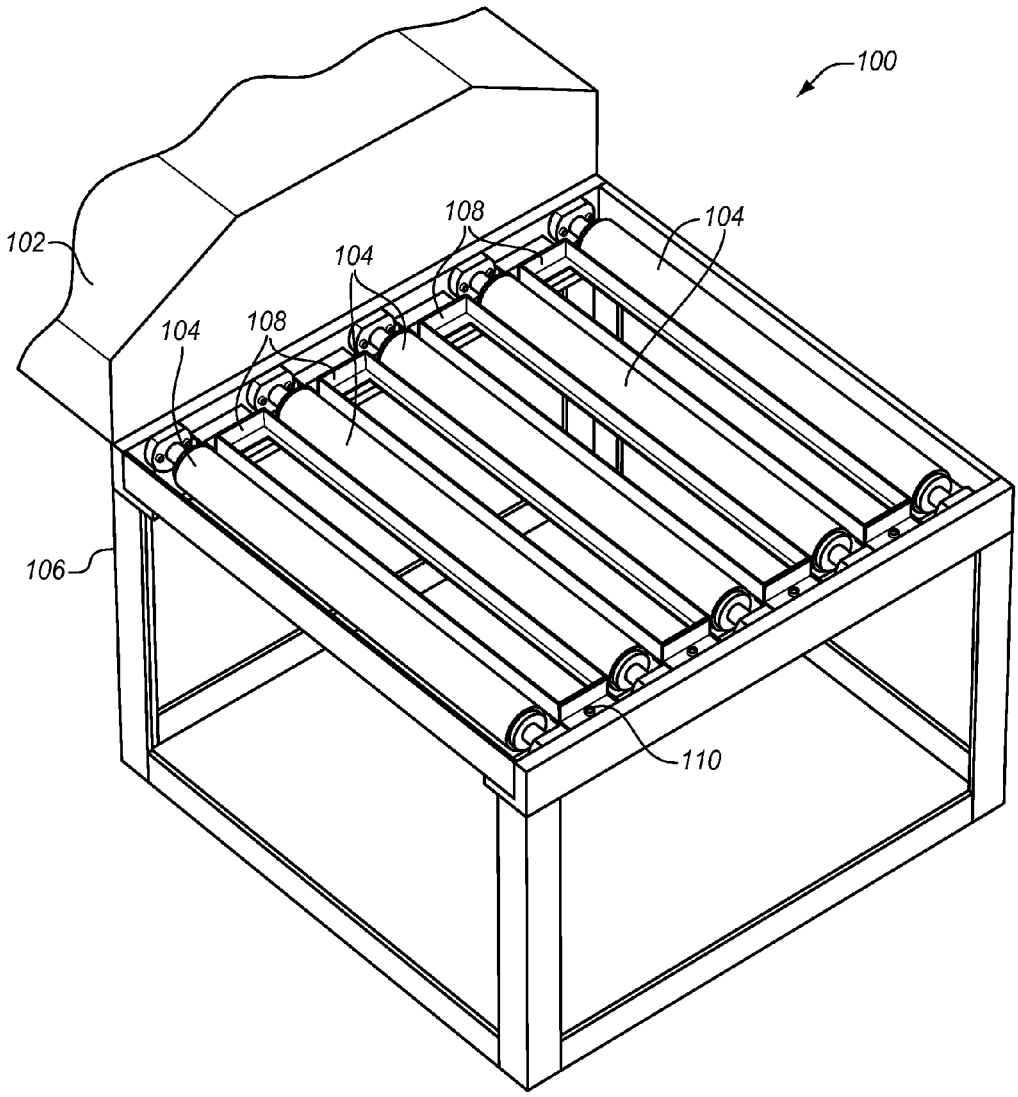
FIG. 9 illustrates a printing system with tray inserts removed in an exemplary embodiment of the invention.
Figure 10:
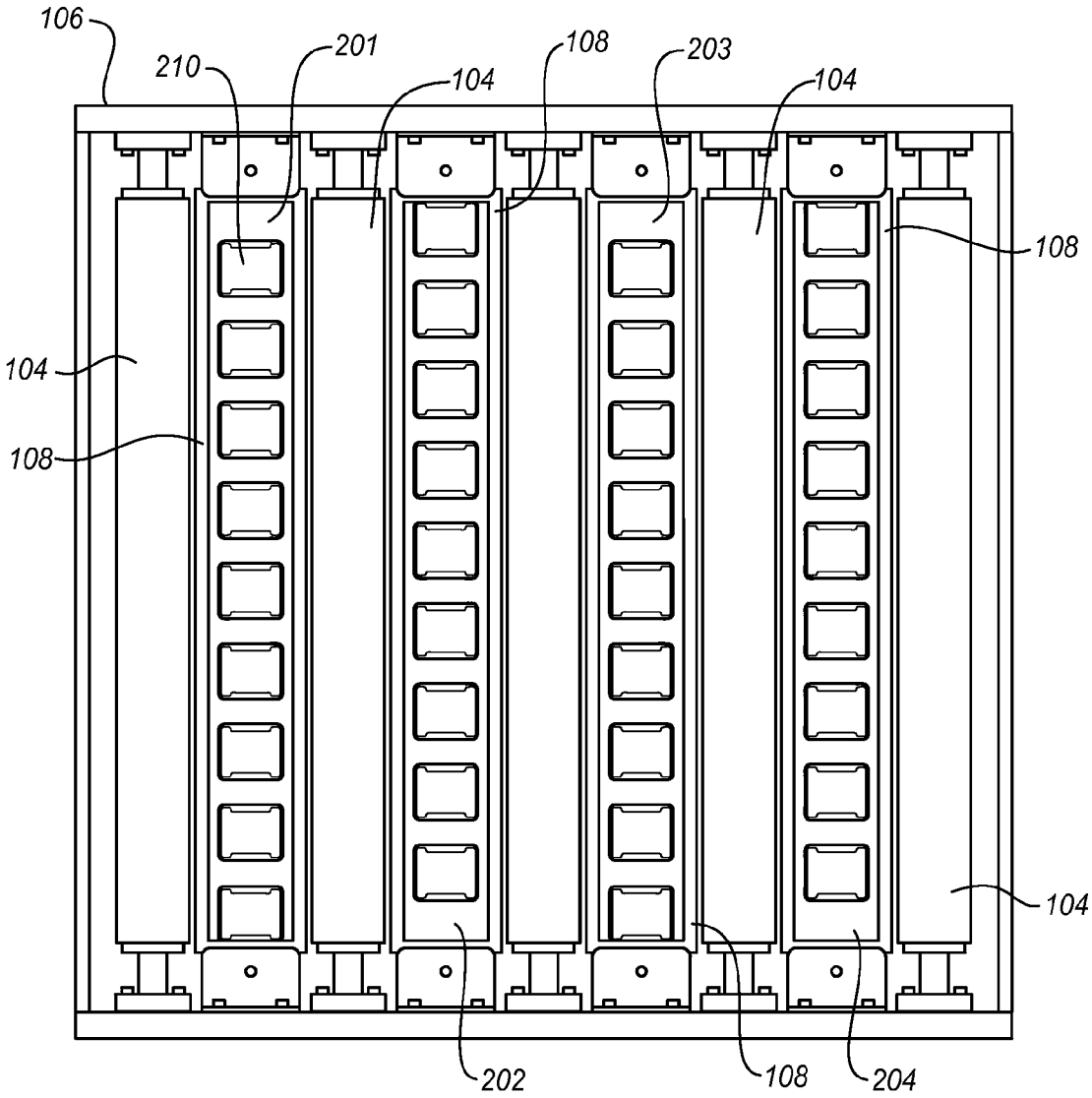
FIG. 10 illustrates the view of printhead arrays through ink trays in an exemplary embodiment of the invention.

Assume for example that the printer operator wants to inspect one or more of the printheads 210 in printhead arrays 201-204. To do so, the printer operator may break the printable medium, and lift the tray inserts 722 from ink trays 108 and transport tray inserts 722 to another location. FIG. 9 illustrates printing system 100 with tray inserts 722 removed in an exemplary embodiment of the invention. The printhead arrays 201-204 may then be moved from the parked position to the printing position. While in the printing position, the printer operator may look upward into printing system 100 to inspect the printheads 210. FIG. 10 illustrates the view of printhead arrays 201-204 through ink trays 108 in an exemplary embodiment of the invention. FIG. 10 shows that the printer operator will advantageously be able to view the printheads 210 through the openings in ink trays 108, and clean printheads 210 if necessary. Thus, the printer operator will not need to detach the ink trays 108 from printing system 100 in order to inspect or clean printheads 210.

Figure 11:
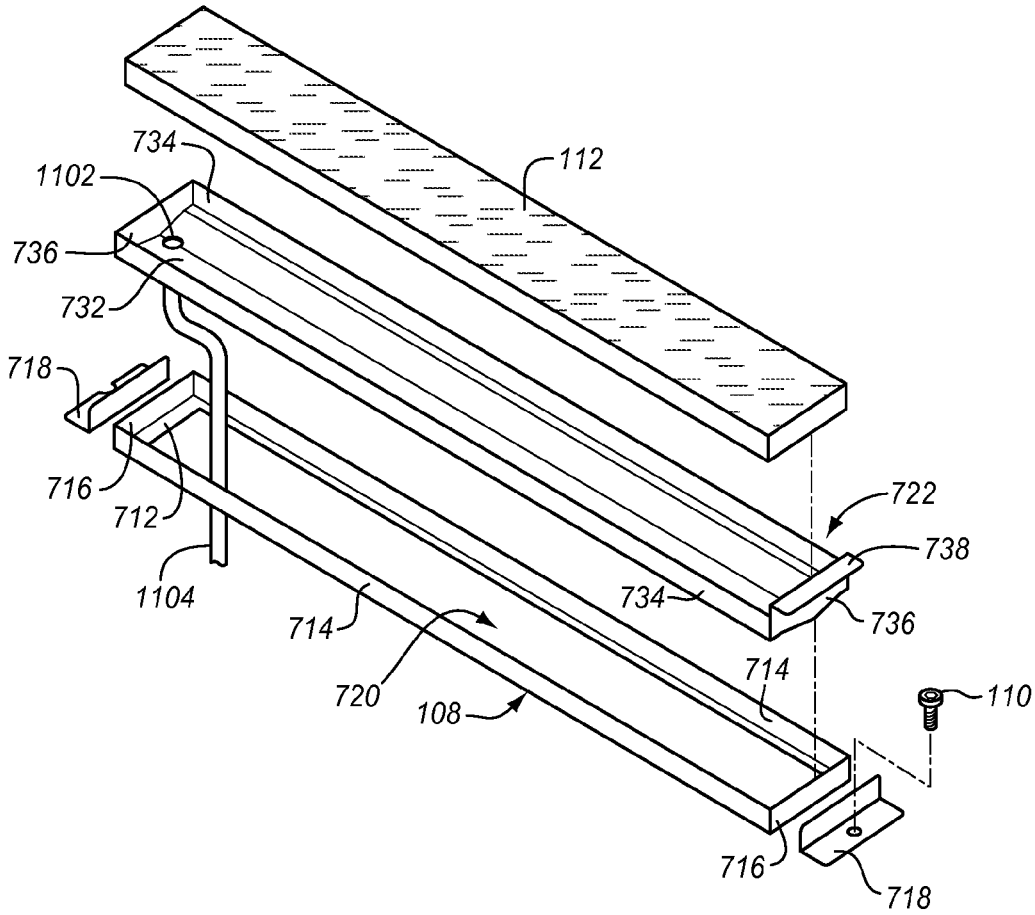
FIG. 11 is an isometric view of a tray insert with a drain in an exemplary embodiment of the invention.

FIG. 11 is an isometric view of a tray insert 722 with a drain in another exemplary embodiment of the invention. In this embodiment, bottom section 732 of tray insert 722 includes a drain 1102. Drain 1102 comprises some type of opening that allows ink to empty from tray insert 722 while tray insert 722 is resting in ink tray 108. Although drain 1102 is illustrated on one end of tray insert 722, those skilled in the art will appreciate that drain 1102 may be fabricated in different locations of bottom section 732. Also, although drain 1102 is illustrated on bottom section 732, drain 1102 may be fabricated on one of the side sections 734 proximate to the bottom section 732 in other embodiments.

In order to influence the flow of ink toward drain 1102, bottom section 732 may slope toward the location of drain 1102. For example, bottom section 732 may have an angled shape as shown in FIG. 11 where the outer portions of bottom section 732 are raised in relation to the center portion so that overall shape of bottom section 732 slopes toward the center portion. Drain 1102 may then be fabricated at or near the center portion. Alternatively, bottom section 732 may have a concave or bowl shape, with drain 1102 fabricated at or near the bottom of the bowl.

Drain 1102 may be fabricated toward one end of bottom section 732 as illustrated in FIG. 11, or may be fabricated toward the center of bottom section 732. If drain 1102 is fabricated toward one end, then bottom section 732 may have a shape that slopes toward the end having drain 1102. If drain 1102 is fabricated toward the center, then bottom section 732 may have a shape so that both ends slope toward the center.

Drain 1102 is able to empty excess ink that pools in the bottom of tray insert 722. To empty the excess ink, a drain tube 1104 may be connected between drain 1102 and an ink storage container (not shown). As printing system 100 is in operation, drain 1102 may empty the excess ink in tray insert 722 so that ink absorbing elements 112 will not become saturated as quickly. Thus, printing system 100 may operate for a longer time period before the ink absorbing elements 112 have to be changed. If the printer operator determines that the ink absorbing elements 112 have become saturated, then tray inserts 722 may be removed and the ink absorbing elements 112 may be replaced.

Although specific embodiments were described herein, the scope of the invention is not limited to those specific embodiments. The scope of the invention is defined by the following claims and any equivalents thereof.

I claim:

1. A production printing system, comprising:

a printhead array operable to discharge ink to print on a printable medium;

an ink tray that is affixed in the printing system facing the printhead array and having a bottom section that is open;

a tray insert adapted to rest in the ink tray and to be lifted from the ink tray; and an ink absorbing element adapted to rest in the tray insert and operable to absorb ink that is discharged from the printhead array when the ink does not contact the printable medium;

wherein the opening in the bottom section of the ink tray has a width at least as wide as the printhead array so that the entire printhead array is visible.

2. The production printing system of claim 1 wherein the ink tray includes:

two side sections, two end sections, and the bottom section that are connected to one another;

wherein the bottom section includes a border that connects to the two side sections and the two end sections, and includes an opening in the center portion of the bottom section.

3. The production printing system of claim 2 wherein the border is less than one inch wide with the remainder of the bottom section comprising the opening.

4. A production printing system having a printhead array operable to discharge ink, the production printing system comprising:

an ink tray affixed in the printing system to face the printhead array and having a bottom section with an opening;

a tray insert that fits in the ink tray and has a container structure that is open at the top to receive an ink absorbing element operable to absorb ink that is discharged from the printhead array outside of the margin of the printable medium, and is enclosed at the bottom to contain a liquid;

wherein the tray insert is adapted to be lifted from the ink tray to remove the ink absorbing element from the printing system;

wherein the printhead array is visible through the opening in the ink tray when the tray insert is removed;

wherein the opening in the bottom section has a width at least as wide as the printhead array so that the entire printhead array is visible.

5. The production printing system of claim 4 wherein the ink tray includes:

two side sections, two end sections, and the bottom section that are connected to one another;

wherein the bottom section includes a border that connects to the two side sections and the two end sections, and includes the opening in the center portion of the bottom section.

6. The production printing system of claim 5 wherein the border is less than one inch wide with the remainder of the bottom section comprising the opening.

7. A production printing system, comprising:

a plurality of rollers operable to support a first surface of a printable medium;

a plurality of printhead arrays operable to discharge ink to print on a second surface of the printable medium;

a plurality of ink trays that are affixed in the printing system proximate to the rollers and facing the printhead arrays;

a plurality of tray inserts each adapted to rest in one of the ink trays and to be lifted from the ink trays; and a plurality of ink absorbing elements each adapted to rest in one of the tray inserts and operable to absorb ink that is discharged from the printhead arrays outside of the margin of the printable medium;

wherein at least one portion of a bottom section in each of the ink trays has an opening having a width at least as wide as a printhead array so that the entire printhead array is visible through the bottom of the ink tray when the tray insert is removed.

8. The production printing system of claim 7 wherein each of the ink trays includes:

two side sections, two end sections, and the bottom section that are connected to one another;

wherein the bottom section includes a border that connects to the two side sections and the two end sections, and includes the opening in the center portion of the bottom section.

9. The production printing system of claim 8 wherein the border is less than one inch wide with the remainder of the bottom section comprising the opening.

10. An ink tray for a production printing system having a printhead array operable to discharge ink, the ink tray comprising:

two side sections;

two end sections; and a bottom section that includes a border that connects to the two side sections and the two end sections, and includes an opening inside the border;

wherein the opening in the bottom section has a width at least as wide as the printhead array so that the entire printhead array is visible.

11. The ink tray of claim 10 wherein the printhead array is visible through the opening.

12. The ink tray of claim 10 wherein the border is less than one inch wide with the remainder of the bottom section comprising the opening.

* * * * *